United States Patent [19]

Papst et al.

[11] Patent Number: 4,865,626

[45] Date of Patent: Sep. 12, 1989

[54] PROCESS FOR PRODUCING GAS CONTAINING CO AND $H_2$

[76] Inventors: Gero Papst, Hasselstrasse 8, 4404 Kaarst; Rolf Hauk, Friedrichstrasse 45, 4000 Düsseldorf; Walter Maschlanka, Zeppelinstrasse 2, 7560 Gaggenau, all of Fed. Rep. of Germany

[21] Appl. No.: 225,241

[22] Filed: Jul. 28, 1988

Related U.S. Application Data

[63] Continuation-in-part of Ser. No. 917,415, Oct. 10, 1986, abandoned.

[30] Foreign Application Priority Data

Oct. 21, 1985 [DE] Fed. Rep. of Germany ..... 3537758

[51] Int. Cl.[4] ..... C10J 3/54

[52] U.S. Cl. ..... 48/210; 48/203; 252/373

[58] Field of Search ..... 48/202, 203, 206, 210, 48/DIG. 2, DIG. 4; 201/31, 42; 252/373

[56] References Cited

U.S. PATENT DOCUMENTS 3,867,110 2/1975 Schora et al. ..... 48/210

FOREIGN PATENT DOCUMENTS 2700281 7/1978 Fed. Rep. of Germany ..... 48/206

*Primary Examiner*—Joye Woodard

*Attorney, Agent, or Firm*—Barnes & Thornburg

[57] ABSTRACT

A process for producing gas containing CO and $H_2$ from pulverulent to coarse-grained coal in a coal gasifier in which a fluidized bed is produced, and to which are supplied coal, oxygen and/or one or more oxygen-containing gases. The coal is supplied in counter-current to the gas removed from the fluidized bed. Thus, the coal is dried, degassed and preheated before it enters the fluidized bed. The upper limit of the particle size of the coal is between about 10 mm and 40 mm, and is determined by the volatile matter content of the coal.

5 Claims, 1 Drawing Sheet

PROCESS FOR PRODUCING GAS CONTAINING CO AND $H_2$

CROSS-REFERENCE TO RELATED APPLICATION

This application is a continuation-in-part of application Ser. No. 917,415 filed Oct. 10, 1986, now abandoned.

BACKGROUND OF THE INVENTION

The invention relates to a process for producing gas containing CO and $H_2$ from pulverulent to coarse-grained coal in a fluidized bed of a gasifier, to which coal and exothermically reacting gasification agents are supplied through various inlets in the gasifier. The invention also relates to an apparatus for performing the process.

A number of different processes are known for producing gases containing CO and $H_2$. In the so-called high temperature Winkler (HTW) process, preferably brown coal is brought to the gasifier pressure by means of a lock system and is then introduced into the lower part of the gasifier where it undergoes gasification. The disadvantage of this process is that gasification takes place at relatively low temperatures and the coal ash is discharged dry. As a result the production of CO and $H_2$ in the gas produced is not generally high enough to permit the further use of the gas without subsequent treatment. In addition, casing and agglomerations of the pasty ash particles occur and there are problems when discharging the ash. The process is mainly intended for highly volatile, highly reactive coals, the coal conversion dropping considerably in the case of low volatility coals.

In the so-called Shell-Koppers process, there is an autothermic gasification of coal dust with oxygen or air and water vapor. The coal dust and gasification agents are introduced into the reactor in counter-current. Gasification takes place under pressure and under slagging conditions. Temperatures above 1400° C. and pressures in the range 20 to 40 bar are sought.

It is disadvantageous that the coal must be ground into powdered form and consequently additional costs are incurred. It has also proved very difficult to dose the coal, because in this process it is necessary to stoichiometrically add coal and oxygen in order to achieve an optimum gas quality and a high carbon conversion.

DE-OS No. 27 50 725 discloses a process for producing a substantially CO and $H_2$-containing gas by gasifying aronaceous fuels in a melt, in which introduction takes place of the fuel and at least one oxidizing gasification agent. In this process, the fuel cannot be fed into the melt in the coarse-grained state and instead requires grinding. With respect to the stoichiometric addition, this process leads to the same disadvantages as in the Shell-Koppers process. The process is also limited to the use of low volatility coals, because otherwise there would be excessive spattering or an excessive temperature drop in the melt.

Finally, German patent 1 017 314 discloses a process for producing combustible gases, particularly synthesis gases, from pulverulent to coarse-grained fuels, in which the fuel layer is in an up an down whirling movement through the gasification agents and the gasification residues are removed in liquid or molten form. The endothermically reacting gasification agents are introduced into the upper part of the gas producer fuel layer, while the exothermically reacting gasification agents are introduced into the lower part thereof. The fresh fuel is either fed into the gas producer above the introduction point of the endothermically reacting gasification agents or between the introduction points of the exothermically and endothermically reacting gasification agents.

The use of different gasification agents and the supply of coal to the fluidized bed leads to considerable limitations with respect to the usability of the coal. If coal with a high proportion of volatile constituents and/or moisture is introduced, a relatively pronounced cooling takes place in the lower part of the gasifier, which impedes molten slag discharge. There is consequently a restriction to the use of certain high quality coal types. As a result of the supply of endothermic gasification agents, the gas produced has an excessive $CO_2$ and possibly $H_2O$ content for reduction purposes and e.g. the following composition is obtained: 10% $CO_2$; 50% CO; 36% $H_2$; 0.5% $CH_4$; 3.5% $N_2$.

On the basis of this prior art, the problem of the present invention is to provide a process for producing gas containing CO and $H_2$ from pulverulent to coarse-grained coal with low proportions of $CO_2$ and $H_2O$ in a fluidized bed of a gasifier, to which coal and exothermically reacting gasification agents are supplied through different inlets in the gasifier, in such a way that the exothermically reacting gasification agents are substantially introduced into the lower part of the fluidized bed, which can be operated with pulverulent to coarse-grained coal of different qualities and in which there is a high thermal efficiency, whereby the slag can be removed in molten form.

SUMMARY OF THE INVENTION

The invention is characterized in that the coal is supplied to the fluidized bed in counter-current to the gas removed therefrom. When the coal enters the free board space or killing region of the gasifier above the fluidized bed, there is a spontaneous drying and degassing of the coal particles, so that independently of their initial state, they acquire the characteristics appropriate for gasification in the fluidized bed. The endothermic processes lead to a temperature drop in the upper part of the fluidized bed and ensure that only the coal constituents bringing about a high gasification temperature enter the lower part of the fluidized bed.

This ensures molten slag tapping at all times. The coal is heated by the counter-flowing gas, so that there is a high degree of thermal efficiency.

The height of the fluidized bed also has a marked influence on the $CO_2$-content of the gas produced. On reducing the fluidized bed height, the temperature in the gasifier head rises, because the gas produced upstream of the oxygen blow-in nozzles has a higher temperature on leaving the fluidized bed. However, if the fluidized bed height is not adequate, the $CO_2$-content of the gas can rise, because the residence time of the $CO_2$ formed in the fluidized bed upstream of the oxygen blow-in nozzles is too short to permit conversion back to CO. Therefore an optimum fluidized bed height is sought, which is in the range 1 to 5 m and preferably 1.5 to 3 m.

Great importance is also attached to the superficial fluid velocity of the gas produced in the gasifier. A rise in said velocity leads to a higher heat exchange between the hot zone upstream of the oxygen blow-in nozzles and the upper part of the fluidized bed. This heat is also transferred into the gasifier head, so that the gas temperature is increased and consequently its $CO_2$-content decreased. However, the superficial fluid velocity must not be made too high, because otherwise the entrainment of solid particles from the gasifier becomes excessive. It is therefore appropriate to set the superficial fluid velocity of the gas, as measured in the free board space or killing region, at a value between 0.2 and 1.4 m/s, preferably between 0.6 and 0.8 m/s. The appropriate superficial fluid velocity value of the gas can be achieved by controlling the supply of coal and gasification agents into the fluidized bed or the rate of gas removal from the free board space of the gasifier.

In addition, a reduction of the average particle diameter of the coal leads to a greater heat exchange between the lower hot part of the fluidized bed and the colder areas above it. It can therefore be advantageous to choose different particle sizes for coal with different volatile constituent contents.

In order to obtain an optimum temperature distribution in the gasifier and therefore a low $CO_2$-content in the gas, as a function of the content of volatile matter in the coal, preference is given to the use of the following particle sizes:

Up to 20% volatile matter approximately 2.5 to 10 mm 20 to 30% volatile matter approximately 2.5 to 20 mm 30 to 40% volatile matter approximately 2.5 to 30 mm 40 to 50% volatile matter approximately 2.5 to 40 mm Thus, the preferable upper limit of the particle size of the coal is between about 10 mm and 40 mm, the upper limit being determined by the content of volatile matter in the coal such that:

$$U=(100m_v/M)-10,$$

where U is the upper limit expressed in mm, and $m_v/M$ is the fractional content of volatile matter in the coal.

In order to extend the range of usable coals, it can be advantageous in the case of extremely poor coal qualities to preheat the gasification agent by means of a plasma burner. It is also possible to preheat in this way returned process gas and to use it for introducing heat into the gasifier.

A reduction in the moisture content of the coal supplied by 1% leads to a temperature rise in the gasifier head of approximately 30° C., which represents a significant drop in the $CO_2$-content. It is therefore advantageous to supply coal with a moisture content between 2 and 7%, preferably 4 to 5%. For this purpose, it is optionally possible to integrate a coal drying apparatus into the installation.

It is also known that during fluidized bed gasification a large amount of dust consisting of coke fines is discharged from the gasifier with the gas and separated in a cyclone. In order to influence the exhaust gas temperature and therefore the gas quality of the gasifier, it has proved appropriate to supply the dust by means of returned process gas to a burner and to gasify it by means of oxygen. Through the choice of an appropriate oxygen quantity and through fixing the blow-in level in the gasifier, it is possible to optimize the gas quality.

BRIEF DESCRIPTION OF THE DRAWING

The invention is described in greater detail hereinafter relative to embodiments shown in the drawings.

DETAILED DESCRIPTION OF A PREFERRED EMBODIMENT

Figure 2:
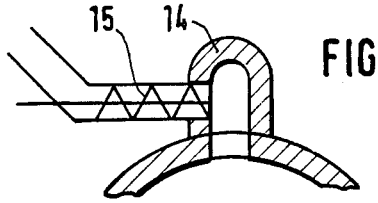
FIG. 2 shows a modified embodiment of the gasifier head.
Figure 1:
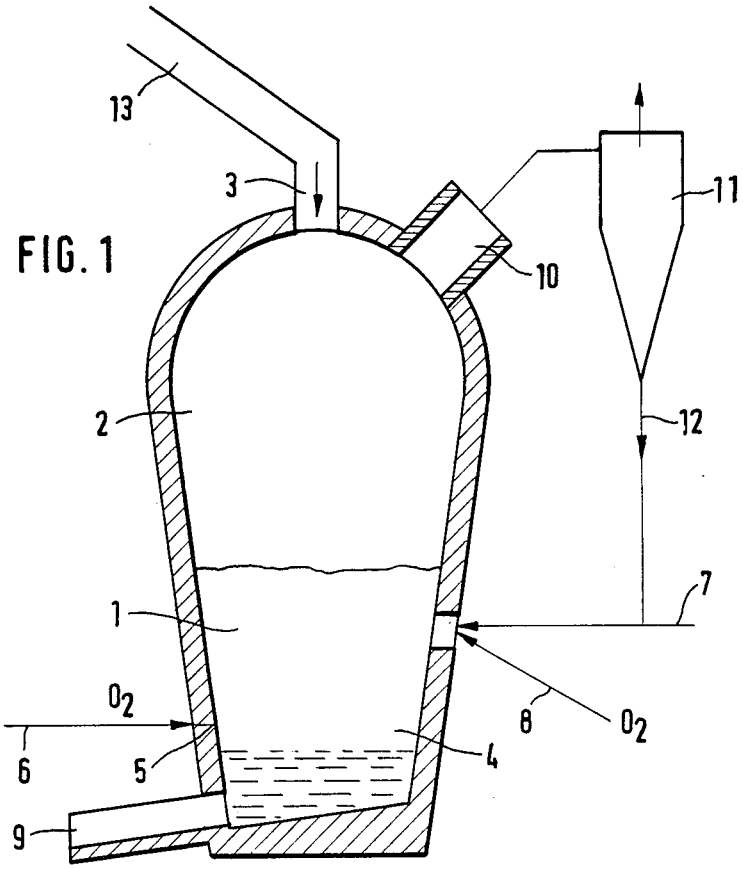
FIG. 1 shows a gasifier in a simplified cross-sectional view.

Lump coal is introduced by means of a down pipe 13 and one or more inlets 3 in the gasifier head into a gasifier having a fluidized bed region 1 and a free board space or killing region 2. The coal can both be fine and coarse-grained. The coal passes through the killing region 2 into the fluidized bed region 1 and is gasified therein with the aid of oxygen or oxygen-containing gas supplied from an oxygen source 6 and blown into a region 4 below the fluidized bed region 1. A molten slag tapping point 9 is located in the vicinity of the bottom of the gasifier.

The gas flowing in counter-current manner to the coal out of the fluidized bed region 1 and through the killing region 2 is led to an outlet 10.

Any coke fines carried with the gas in the form of dust is separated in a hot cyclone 11 and is returned to the gasifier with the feed gas via a pipe 12. The feed gas is supplied by means of pipe 7. Gasification of the dust takes place by means of oxygen supplied via a pipe 8.

Through the coal and gas being in counter-current, intimate mixing takes place in the killing region 2 between said coal and gas, so that there is a preheating, drying and degassing of the coal and also part of the $CO_2$ in the gas reacts with the carbon of the coal, accompanied by the formation of CO. This increases the proportion of reducing constituents in the gas and decreases the proportion of oxidizing constituents. The gas purified in the hot cyclone 11 is therefore particularly suitable for reduction purposes.

FIG. 2 shows a modification of the gasifier head in the vicinity of the coal inlet. A cap 14 is mounted on the gasifier, into which the coal is transported by means of a worm 15, before it drops into the gasifier.

Although the invention has been described in detail with reference to certain preferred embodiments, variations and modifications exist within the scope and spirit of the invention as described and as defined in the following claims.

What is claimed is:

1. A process for producing gas containing CO and $H_2$ in a gasifier having essentially two regions, a fluidized bed in a bottom region of the gasifier and a free board space above the fluidized bed in a top region of the gasifier, the process comprising the steps of:

supplying lump coal having a moisture content of between about 2 and 7% from the top region through the free board space into the fluidized bed, the coal having a particle size from a lower limit of about 2.5 mm to an upper limit between about 10 mm and 40 mm, the upper limit being determined by the content of volatile matter in the coal such that:

$$U=(100m_v/M)-10,$$

where U is the upper limit expressed in mm, and $m_v/M$ is the fractional content of the volatile matter in the coal.

supplying exothermically reacting gasification agents into the fluidized bed through inlets in the bottom region of the gasifier, the fluidized bed being maintained at a height of between about 1 and 5 m; and removing the gas produced in the fluidized bed from the free board space of the gasifier countercurrent to the coal being supplied to the fluidized bed at a rate such that the superficial fluid velocity of the gas measured in the free board space is between about 0.2 and 1.4 m/s.

2. The process of claim 1 wherein the height of the fluidized bed is maintained between about 1.5 and 3 m.

3. The process of claim 1 wherein the removal rate of gas produced during the process is controlled such that the superficial fluid velocity of the gas is between about 0.6 and 0.8 m/s.

4. The process of claim 1 wherein the moisture content of the coal supplied to the gasifier is maintained between about 4 and 5%.

5. The process of claim 1 further comprising the steps of separating entrained dust from the gas produced, and returning the dust to the fluidized bed of the gasifier above the point of supply of said exothermically reacting gasification agents.

* * * * *